US011199018B2

(12) United States Patent
Rogers

(10) Patent No.: US 11,199,018 B2
(45) Date of Patent: Dec. 14, 2021

(54) SECURE, TWO-PIECE POLE HOLDER

(71) Applicant: Cool Pool Products, LLC, The Colony, TX (US)

(72) Inventor: Scott Rogers, The Colony, TX (US)

(73) Assignee: Cool Pool Products, LLC, The Colony, TX (US)

( * ) Notice: Subject to any disclaimer, the term of this patent is extended or adjusted under 35 U.S.C. 154(b) by 0 days.

(21) Appl. No.: 16/691,105

(22) Filed: Nov. 21, 2019

(65) Prior Publication Data

US 2021/0156165 A1 May 27, 2021

(51) Int. Cl.
*E04H 12/22* (2006.01)

(52) U.S. Cl.
CPC ..... *E04H 12/2223* (2013.01); *E04H 12/2269* (2013.01)

(58) Field of Classification Search
CPC ..... E04H 12/2223; E04H 12/2269
USPC ..... 248/156, 530
See application file for complete search history.

(56) References Cited

U.S. PATENT DOCUMENTS 5,271,196 A 12/1993 Fanti
5,358,209 A 10/1994 Ward
5,535,978 A * 7/1996 Rodriguez ..... E04H 12/2269 135/118
5,625,988 A * 5/1997 Killick ..... E04H 12/2269 248/156
5,906,077 A 5/1999 Andiarena
6,299,124 B1 10/2001 Reback et al.
7,930,859 B1 * 4/2011 Eslambolchi ..... E04H 12/2269 52/103
7,954,289 B2 6/2011 Evans
9,706,820 B1 7/2017 Lopez
2006/0097117 A1 * 5/2006 Yu ..... E04H 12/2269 248/156
2011/0315833 A1 12/2011 Olmeda
2013/0126571 A1 * 5/2013 Field ..... A45B 25/26 224/613
2013/0206954 A1 * 8/2013 Wells ..... E04H 12/2269 248/523

(Continued)

FOREIGN PATENT DOCUMENTS

JP 2016053268 A * 4/2016

OTHER PUBLICATIONS https://worldwide.espacenet.com/patent/search/family/055744913/publication/JP2016053268A?q=pn%3DJP2016053268A English Translation of FOR Reference JP201653268A. Name; Kameyama Motonori (Year: 2016).*

(Continued)

*Primary Examiner* — Muhammad Ijaz
(74) *Attorney, Agent, or Firm* — Sheri Higgins Law, PLLC; Sheri Higgins

(57) ABSTRACT

A two-piece pole holder includes an insert and a base. The insert is embedded within soil or concrete. The base is threadingly connected to the top of the insert to form the pole holder. The insert has a solid bottom end for receiving a pole. The bottom end of the insert can also include a drain opening for allowing water to drain. The pole can be an outdoor umbrella pole or volleyball net poles. The inner diameter and height of the insert and the base are selected such that improved stability is provided to the pole such that the pole does not tip over in strong winds. The pole holder can be installed in a water feature, such as a swimming pool.

20 Claims, 3 Drawing Sheets

(56) References Cited

U.S. PATENT DOCUMENTS

| | | | | |
|---|---|---|---|---|
| 2015/0090857 | A1 | 4/2015 | Walker | |
| 2015/0194774 | A1* | 7/2015 | McRae | A47G 33/06 439/105 |
| 2015/0225041 | A1* | 8/2015 | Lovett | A43B 7/144 441/21 |
| 2016/0060891 | A1* | 3/2016 | Walker | E04H 12/347 248/523 |

OTHER PUBLICATIONS

Abstract translation of JP2016053268A Name; Kameyama Motono (Year: 2016).*

* cited by examiner

SECURE, TWO-PIECE POLE HOLDER

TECHNICAL FIELD

The field relates to a holder for receiving a pole, such as a volleyball net or outdoor umbrella. The holder can be installed in a swimming pool or an outdoor patio. The holder provides increased stability for the pole such that the pole is not easily dislodged from the holder.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 2:
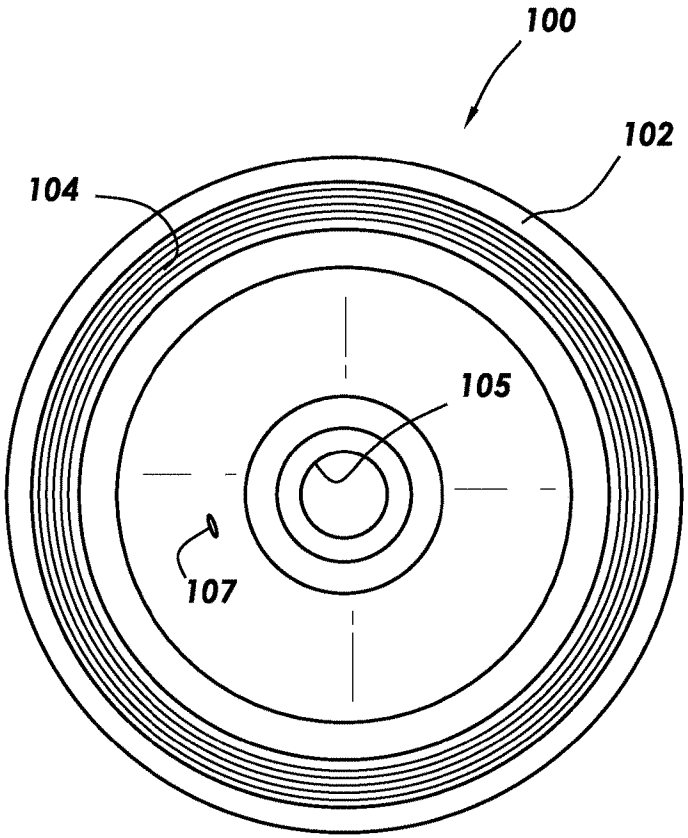
FIG. 2 is a top view of the insert according to certain embodiments.

Many people enjoy outdoor activities such as playing outdoor sports like volleyball or badminton, swimming, and sitting outside. It is often desirable to position one or more outdoor umbrellas for outdoor patios, including patios surrounding a swimming pool. The outdoor umbrellas can provide shade to people on the patio.

Nets are required for some sports such as volleyball and badminton. A pole is an integral part of nets and outdoor umbrellas. For example, a net is secured between two poles; and the material making up an outdoor umbrella is secured to the top of a pole.

Most net poles are simply inserted into the soil. The pole of an outdoor umbrella is also commonly inserted into soil or inserted into a base. Bases for outdoor umbrella poles are generally circular or square in shape and designed to be placed on the surface of the ground or patio. Water volleyball nets for use in a swimming pool are generally strung between two poles, wherein the poles are inserted into two bases located on the patio surface at the perimeter of the swimming pool or the pole bases float in the water.

However, there are several disadvantages to common pole bases. For poles inserted into soil or a traditional base, the pole can easily move in high winds, become angled, and even fall over. Moreover, most bases—especially bases for water volleyball—do not provide sufficient support and stability to the net poles. This lack of support and stability results in undesirable movement of the net and one or both poles being knocked over if the volleyball hits the net with sufficient force.

Thus, there is a need for an improved pole holders that provide sufficient support and stability to the pole such that the pole remains in a fixed position even in high winds or another force applied to the pole.

It has been discovered that a pole holder can include an insert that is embedded in soil or concrete and a base that threadingly connects to the insert. The pole holder provides increased support and stability to the pole such that movement or dislodgement of the pole is greatly diminished or eliminated when the pole is contacted with a force, such as high winds.

According to certain embodiments, a pole holder comprises: an insert, wherein the insert is embedded into soil or concrete; and a base, wherein the base is removably connected to the insert via a threaded connection, wherein a bottom end of the pole is inserted into the base and insert.

According to certain other embodiments, a method for installing a pole holder comprises: embedding an insert into soil or uncured concrete, wherein a top of the insert is +/−1 inch from the surface of the soil or uncured cement; connecting a base to the insert via a threaded connection; inserting a pole into the base and insert after connection of the base to the insert.

It is to be understood that any discussion of any of the components disclosed herein is meant to include the apparatus and method embodiments without the need to repeat information. By way of example, any discussion related to the insert is meant to apply to the apparatus and method embodiments.

Figure 1:
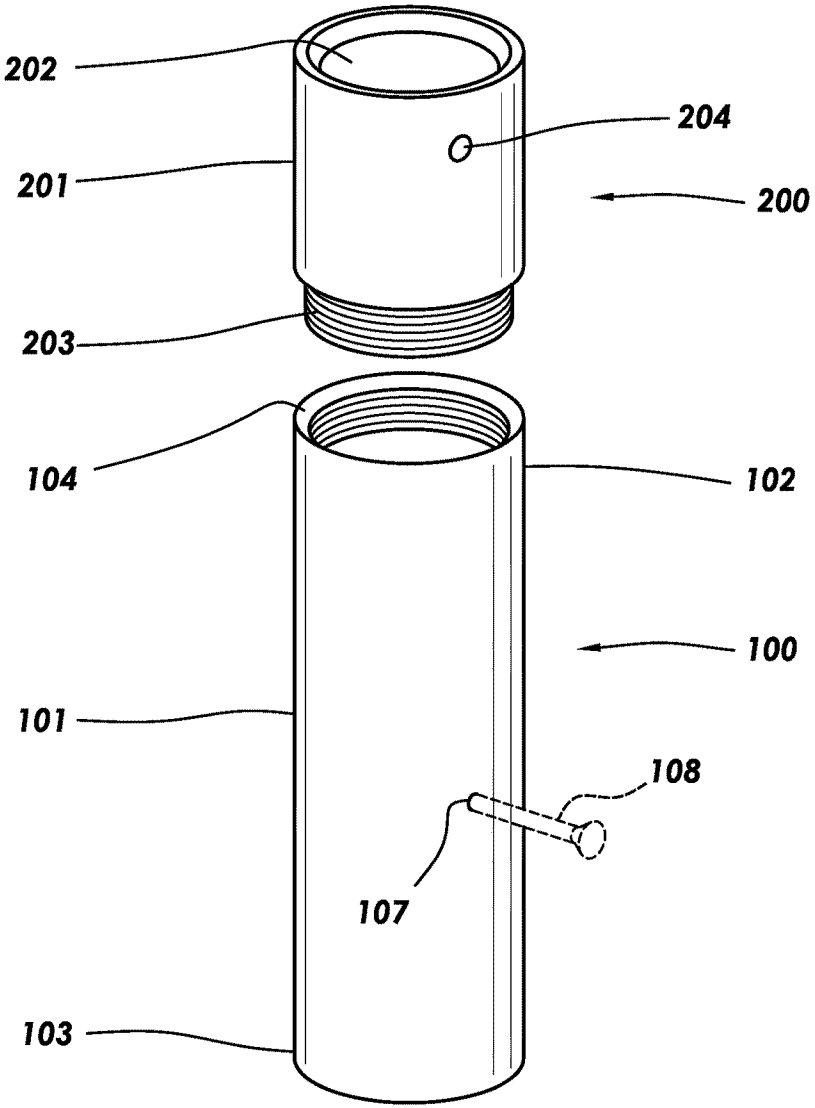
FIG. 1 is a perspective view of a pole holder including an insert and base according to certain embodiments.

Turning to the figures, FIG. 1 shows a pole holder according to certain embodiments. The pole holder includes an insert 100 and a base 200. The insert 100 and the base 200 have an outer diameter (OD) and an inner diameter (ID). The ID defines a void that centrally extends longitudinally through a body 101 of the insert 100 and a body 201 of the base 200. The difference between the OD and the ID defines the thickness of the body 101 of the insert 100 and the body 201 of the base 200. According to certain embodiments, the OD of the insert 100 is the same as the OD of the base 200. According to certain other embodiments, the base 200 has an OD that is larger than the OD of the insert 100. The OD of the insert 100 and the base 200 can range from 1 inch (in) to 6 in (2.54 centimeters (cm) to 15.24 cm). According to certain preferred embodiments, the ID of the insert 100 and the ID of the base 200 are the same. In this manner, improved support and stability is provided to a pole. The ID of the insert 100 and the base 200 can be selected to accommodate the OD of a pole. According to certain embodiments, the ID of the insert and the base are selected such that the pole fits snuggly within the insert and the base, for example, with a clearance of about 1/16 in. The ID of the insert 100 and the base 200 can range from 0.5 in to 5 in (1.27 cm to 12.7 cm). The thickness of the body 101 of the insert 100 and the body 201 of the base 200 can range from 0.25 in to 1 in (0.64 cm to 2.54 cm).

The insert 100 has a top 102 and a bottom 103. The height of the insert 100 is the difference between the top 102 and the bottom 103. According to certain embodiments, the height of the insert 100 is selected such that increased support and stability is provided to the pole. By way of example, as the height of the insert 100 increases so does the support and stability of the pole. By way of another example, the height of the insert 100 may be selected based on the height of the pole. According to this example, as the height of the pole increases, the height of the insert 100 may also need to be increased. The height of the insert 100 can range from 4 in to 8 in (10.16 cm to 20.32 cm).

The base 200 has a top 202 and a bottom. The height of the base 200 is the difference between the top 202 and the bottom. According to certain embodiments, the height of the base 200 is selected such that increased support and stability is provided to the pole. By way of example, as the height of the insert 100 decreases the height of the base 200 may need to be increased in order to provide improved support and stability to the pole. The height of the base 200 does not need to be the same as the height of the insert 100. The height of the base 200 can range from 2 in to 3.5 in (5.08 cm to 8.89 cm).

The base 200 is removably connected to the insert 100 via a threaded connection. As can be seen in FIG. 1, the bottom of the base 200 contains male threads 203. The OD of the male threads 203 can be less than the OD of the body 201 of the base 200. According to certain embodiments, the OD of the male threads 203 tapers in a direction away from the top 202 of the base 200 towards the bottom of the base. The tapered male threads 203 can help improve the ease of connecting the base to the insert and can also prevent the threaded connection from seizing whereby it is difficult to disconnect the base from the insert.

The insert 100 includes female threads 104 for receiving the base 200. The female threads 104 are located at the top 102 of the insert 100. The ID of the female threads 104 can be selected such that the male threads 203 can connect the base 200 to the insert 100. The female threads 104 can also taper in a direction away from the top 102 towards the bottom 103. The degree of tapering of the female threads 104 can be selected to match the degree of tapering of the male threads 203. The ID of the female threads 104 can be larger than the ID of the body 101 of the insert 100. In this manner, after the base 200 is threadingly connected to the insert 100, the body 201 of the base 200 and the body 101 of the insert 100 have substantially the same ID.

The base 200 can also include a hole 204 for receiving a thumb screw 205. The hole 204 penetrates through the entire thickness of the body 201 of the base 200. The hole 204 can include female threads for receiving male threads on the thumb screw 205. The height of the male threads are preferably selected such that an end of the thumb screw located opposite of the head of the thumb screw traverses the entire thickness of the body 201 of the base 200 and enters into the void of the body 201 and can abut the outside of the pole. In this manner, after the pole is inserted into the insert 100 and the base 200, the thumb screw 205 can be tightened to provide added support and stability to the pole.

The insert 100 can also contain a hole 107 for receiving a grounding screw 108. This embodiment can be useful when the pole holder is located in water (e.g., a swimming pool). The grounding screw can be used to ground the pool holder against electrical current and protect people or animals against electric shock. The hole 107 and the grounding screw 108 can be configured as discussed above regarding the thumb screw.

Figure 3:
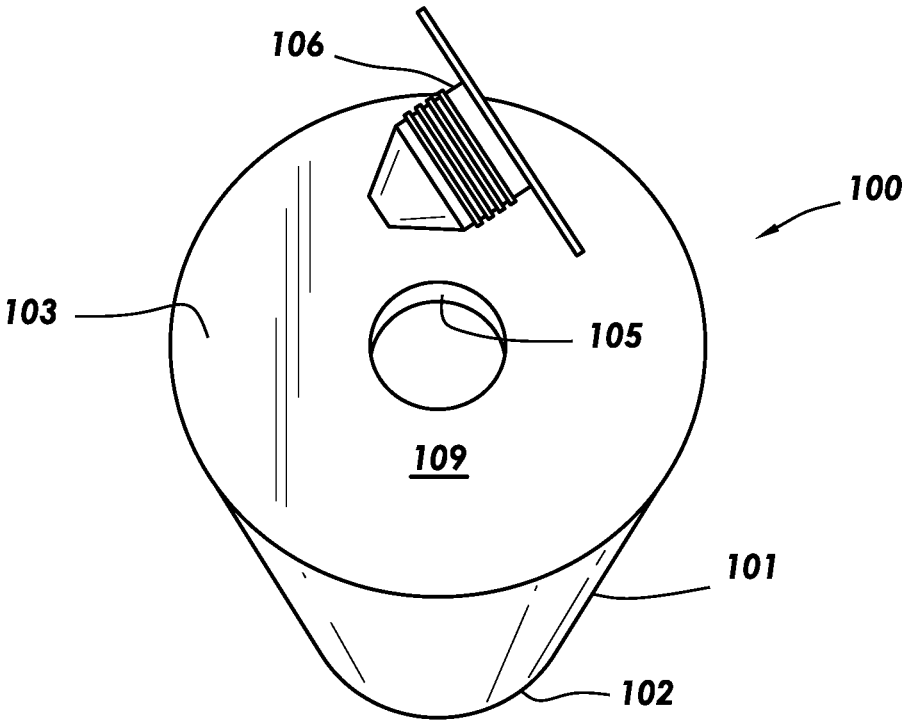
FIG. 3 is a bottom view of the insert of FIG. 2.

FIG. 2 is a top view of the insert 100. As can be seen, the bottom 103 of the insert 100 can include a drain opening 105 for allowing water to drain from the inside of the insert 100. FIG. 3 is a bottom view of the insert 100 showing a circumferential bottom end 109 surrounding the drain opening 105. If the insert 100 does not include a drain opening 105, then the bottom end of the insert would be completely solid to receive a bottom end of the pole. A plug 106 can be used to close the drain opening 105.

Figure 4:
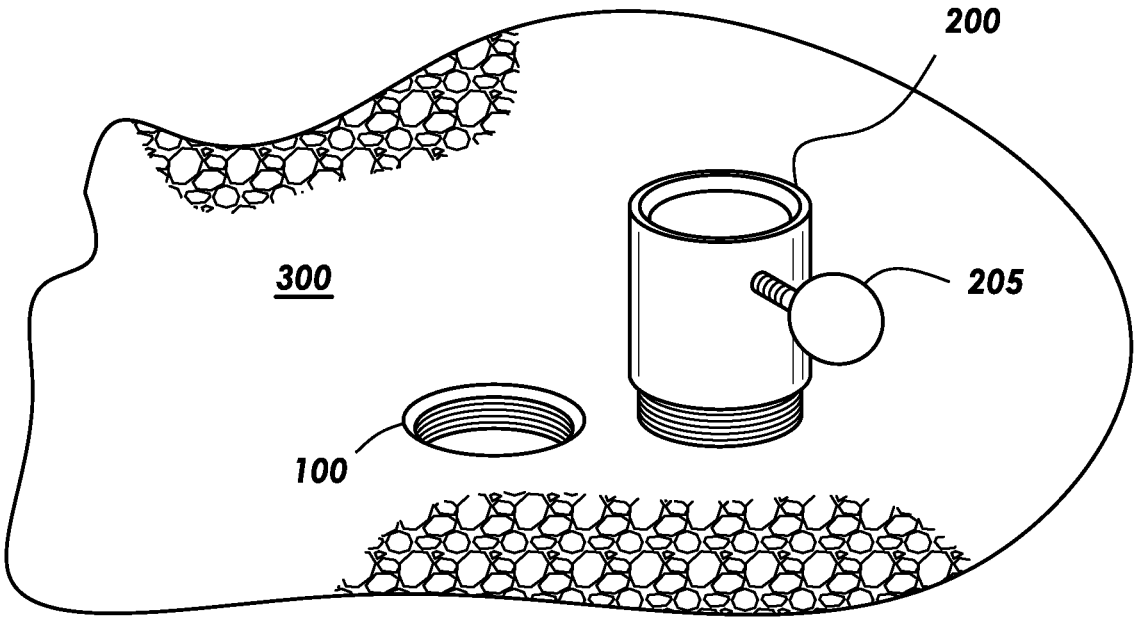
FIG. 4 is a top perspective view of the pole holder showing the insert installed in concrete and the base disconnected from the insert.

The insert 100 is embedded in soil or concrete. FIG. 4 shows the insert 100 being embedded in concrete 300 with the base 200 disconnected. According to certain embodiments, the top 102 of the insert 100 is flush with the surface of the soil or concrete. According to certain other embodiments, the top 102 of the insert 100 is +/−1 inch from the surface of the soil or concrete.

Figure 5:
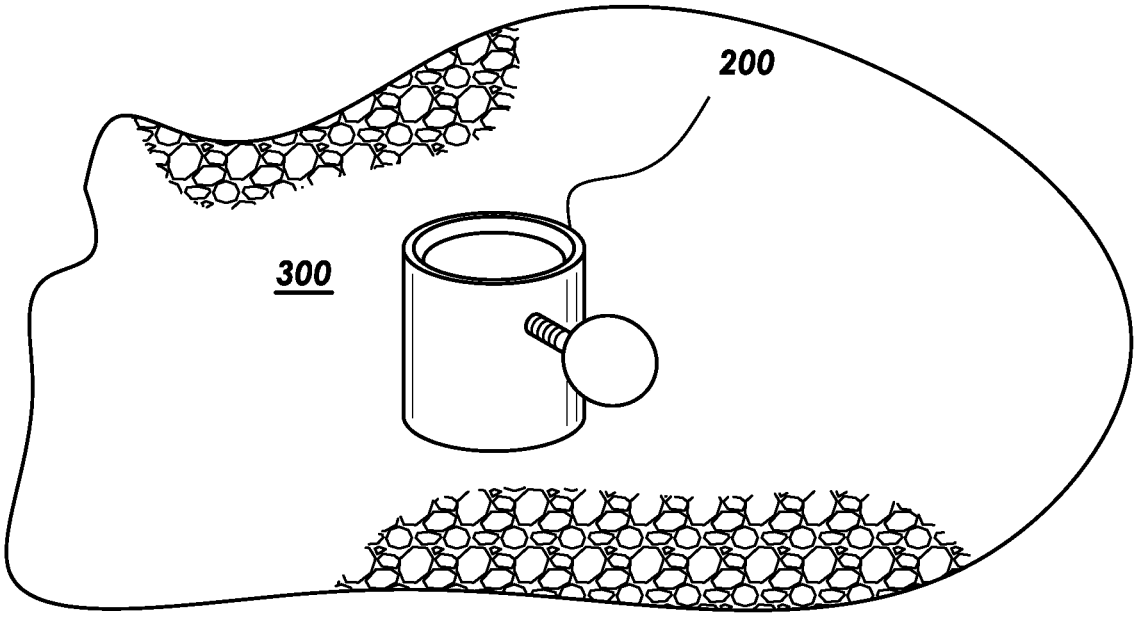
FIG. 5 is a top perspective view of the pole holder of FIG. 4 showing the base connected to the insert.
Figure 6:
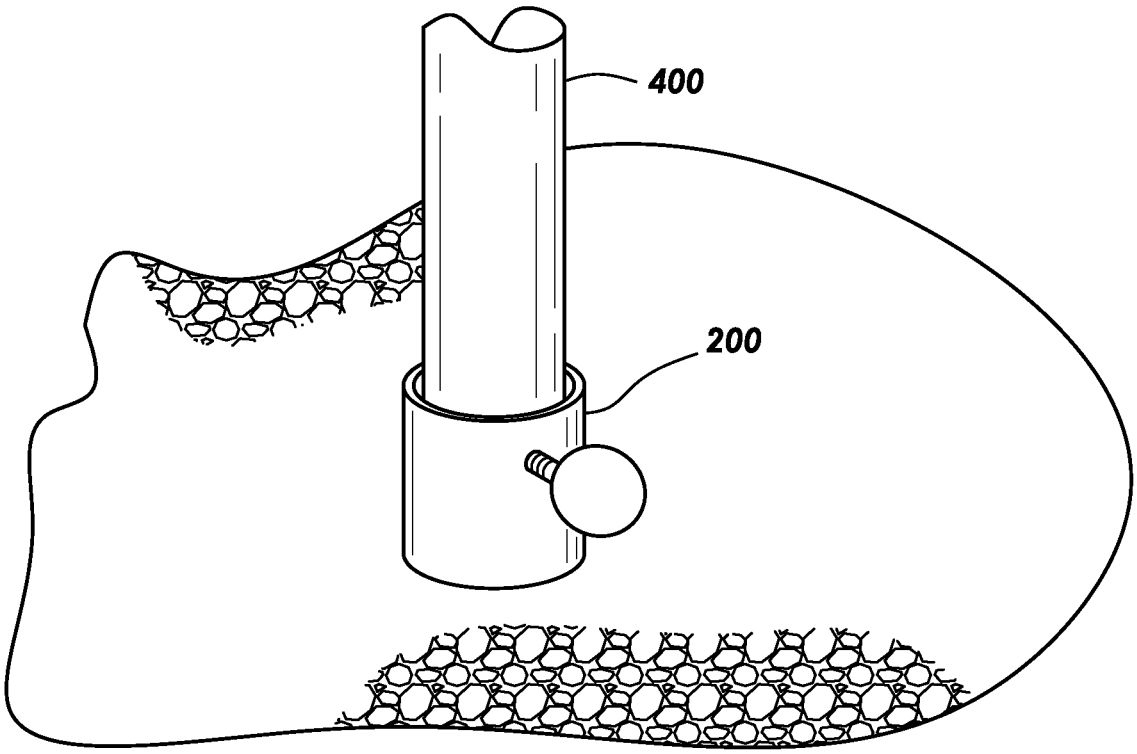
FIG. 6 is front view of the pole holder showing a pole inserted into the holder.

FIG. 5 shows the base 200 threadingly connected to the insert 100. After the base is connected to the insert, a bottom end of a pole 400 can be inserted into the base 200 and insert 100, wherein the bottom end of the pole abuts the bottom end 109 or the solid bottom of the insert 100.

The insert 100, the base 200, and the pole 400 can be made from a variety of materials. The materials can include metals, metal alloys, and hard plastics. As used herein, the term "metal alloy" means a mixture of two or more elements, wherein at least one of the elements is a metal. The other element(s) can be a non-metal or a different metal. The metal or metal alloy can be selected from iron, cast iron, steel, stainless steel, bronze, copper, and brass. The hard plastics can be selected from, for example, polyvinyl chloride (PVC), nylon, or acetal polyoxymethylene resin sold under the tradenames Delrin™ or Delron™.

According to certain embodiments, the pole holder is NEC (National Electrical Code) compliant for grounding water. This embodiment can be useful when the pole holder is located in an area that is in contact with water, for example, in a swimming pool. According to this embodiment and as discussed above, the insert can include the grounding screw 108. According to this embodiment, the base 200 and the insert 100 may be made from a material that allows the pole holder to be certified compliant. By way of example, the base 200 and the insert 100 may be made from stainless steel. Moreover, the dimensions of the insert 100 and the base 200 can be selected such that the pole holder is certified compliant.

Methods include the step of embedding the insert into soil or uncured concrete. The methods can further include causing or allowing the uncured concrete to cure. Curing is the process by which a cement composition such as concrete sets into a hardened substance or solid. The insert can be stabilized while the concrete cures to prevent the insert from moving out of its intended location or orientation. The base can be connected to the insert after the concrete has cured by threading the male threads 203 to the female threads 104. The pole 400 can then be inserted into the base and insert. The optional thumb screw 205 can then be inserted into the hole 107 for additional support and stability.

The methods can further include disconnecting the base 200 from the insert 100 by unscrewing the threaded connection. This can be performed when the pole is not in use or positioned within the pole holder, such as during winter months. In this manner, the base that extends from the surface of concrete or soil does not provide a hazard, such as people tripping over the base. A cap (not shown) can then be placed over the top of the insert 100 after the base 200 is disconnected to prevent water and/or debris from entering into the insert 100 while the pole holder is not being used.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more ends, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A pole holder comprising:

an insert, wherein the insert is configured to be embedded directly into soil or concrete; and a base, wherein the base is removably connected to the insert via a threaded connection, wherein the insert and the base are configured to have a vertical orientation in the soil or concrete for receiving a bottom end of a pole, wherein the insert and the base have an outer diameter and an inner diameter, and wherein the inner diameter defines a void that centrally extends longitudinally through a body of the insert and a body of the base, and wherein the outer diameter of the insert is the same as the outer diameter of the base.

2. The pole holder according to claim 1, wherein the outer diameter of the insert and the base is in a range from 1 inch to 6 inches.

3. The pole holder according to claim 1, wherein the inner diameter of the insert is the same as the inner diameter of the base.

4. The pole holder according to claim 3, wherein the inner diameter of the insert and the base is in a range from 0.5 inches to 5 inches.

5. The pole holder according to claim 3, wherein a difference between the outer diameter and the inner diameter defines a thickness of a body of the insert and the base, and wherein the thickness of the body of the insert and the body of the base is in a range from 0.25 inches to 1 inch.

6. The pole holder according to claim 1, wherein a height of the insert is in the range from 4 inches to 8 inches, and wherein the height of the base is in a range from 2 inches to 3.5 inches.

7. The pole holder according to claim 1, wherein a bottom of the base comprises male threads and a top of the insert comprises female threads for receiving the base.

8. The pole holder according to claim 7, wherein the outer diameter of the male threads tapers in a direction away from a top of the base towards the bottom of the base.

9. The pole holder according to claim 8, wherein the outer diameter of the female threads tapers in a direction away from the top of the insert towards a bottom of the insert.

10. The pole holder according to claim 1, wherein the base further comprises a hole for receiving a thumb screw.

11. The pole holder according to claim 1, wherein the insert further comprises a hole for receiving a grounding screw.

12. The pole holder according to claim 1, wherein a bottom of the insert is solid.

13. The pole holder according to claim 1, wherein a bottom of the insert comprises a circumferential bottom end and a drain opening located in a center of the bottom end.

14. The pole holder according to claim 13, further comprising a plug removably inserted into the drain opening.

15. The pole holder according to claim 1, wherein the insert and the base are made from metals, metal alloys, or hard plastics.

16. The pole holder according to claim 15, wherein the metal or metal alloy is selected from the group consisting of iron, cast iron, steel, stainless steel, bronze, copper, brass, and any combinations thereof, and wherein the hard plastic is selected from polyvinyl chloride (PVC), nylon, or acetal polyoxymethylene resin.

17. The pole holder according to claim 1, wherein the base is configured to be located above a surface of the soil or concrete.

18. The pole holder according to claim 1, wherein the insert and the base are configured to be located within or adjacent to a swimming pool.

19. A method of installing a pole holder comprising:

embedding an insert directly into soil or uncured concrete, wherein a top of the insert is +/−1 inch from a surface of the soil or an uncured cement, and wherein the insert is vertically oriented within the soil or uncured concrete;

connecting a base to the insert via a threaded connection, wherein the insert and the base have an outer diameter and an inner diameter, and wherein the inner diameter defines a void that centrally extends longitudinally through a body of the insert and a body of the base, and wherein the outer diameter of the insert is the same as the outer diameter of the base; and inserting a pole into the base and insert after connection of the base to the insert.

20. The method according to claim 19, further comprising causing or allowing the uncured concrete to cure after embedding the insert into the uncured concrete.

* * * * *